US005092390A

United States Patent [19]

Witt

[11] Patent Number: 5,092,390

[45] Date of Patent: Mar. 3, 1992

[54] METHOD AND MOLD FOR SAND CASTING VARYING THICKNESS ARTICLES

[75] Inventor: Raymond H. Witt, Southfield, Mich.

[73] Assignee: CMI International, Inc., Southfield, Mich.

[21] Appl. No.: 576,218

[22] Filed: Aug. 31, 1990

[51] Int. Cl.[5] ..... B22D 27/15

[52] U.S. Cl. ..... 164/65; 164/127; 164/254; 164/353

[58] Field of Search ..... 164/23, 352, 353, 61, 164/65, 253, 254, 127, 255, 364

[56] References Cited

U.S. PATENT DOCUMENTS 1,560,832 11/1925 Lee ..... 164/353
4,674,553 6/1987 Witt ..... 164/33
4,742,863 5/1988 Witt ..... 164/364

FOREIGN PATENT DOCUMENTS 2175521 12/1986 United Kingdom ..... 164/352

*Primary Examiner*—Richard K. Seidel
*Attorney, Agent, or Firm*—Harness, Dickey & Pierce

[57] ABSTRACT

Molten metal is cast in a cavity formed within a permanent, metal mold. The major portion of the cavity is lined with a sand liner whose thickness is reversely correlated to the thickness of the integral sections of a varying thickness cast metal article. However, portions of the metal cavity are bare and such portions form a part of the interior casting surface defined by the sand liner. Thus, the cast metal contacting the bare metal portions of the mold uniformly and rapidly chills to produce harder surface areas on the finished cast article, while the remaining portions of the cast article tend to cool at a generally equalized cooling rate corresponding reversely to the thickness of the sand liner. A vacuum is applied to the casting cavity during filling with molten metal for rapidly filling the sand lined cavity and insuring complete contact between the molten metal and the bare metal portions of the casting cavity.

3 Claims, 1 Drawing Sheet

METHOD AND MOLD FOR SAND CASTING VARYING THICKNESS ARTICLES

BACKGROUND OF INVENTION

This invention relates to a method for casting molten metal articles, having varying thickness integral sections, within a combination permanent metal and temporary sand mold cavity. Portions of the casting cavity are formed by preselected portions of the permanent metal mold while other portions of the cavity are formed by a temporary sand liner within the cavity. This produces a generally equalized cooling effect on the molten metal, but with preselected areas that are rapidly chilled during the casting for providing harder portions in the cast article.

The underlying method for sand casting articles of varying thickness within a combined permanent mold and sand mold is described in U.S. Pat. No. 4,674,553 issued June 23, 1987 to Raymond H. Witt. That patent discloses the use of a permanent metal mold which is formed with an oversized mold cavity. The cavity is lined with sand to provide an interior sand surfaced casting cavity within which molten metal is poured and solidified.

The thickness of the sand lining is varied and is reversely coordinated, with the thickness of the corresponding areas of the cast article. That is, the sand liner is thinner where the article is thicker and the sand liner is thicker where the article is thinner. The respective thicknesses are correlated to produce a generally equalized cooling of the article, notwithstanding its varying wall thicknesses.

The foregoing method permits more rapid casting of metal articles from molten metal, that is, it permits opening the mold and removing the cast part more rapidly than otherwise expected.

Some cast articles, regardless as to whether formed in a permanent mold or a sand mold or a permanent mold lined with sand as described in U.S. Pat. No. 4,674,553, mentioned above, require localized hardened surface areas for their particular function. For that purpose, heat treating or other surface treatments are utilized for increasing the surface hardness. This requires additional treatment following casting, and, depending upon the configuration of the article, may provide a greater area of surface hardening than is necessary for the particular purpose of the article.

Thus, this invention is concerned with improving the casting of varying wall thickness articles by providing a means for hardening preselected areas of the article during the casting process.

SUMMARY OF INVENTION

This invention contemplates casting a varying thickness article from molten metal within a permanent mold casting cavity which is lined with a varying thickness sand liner that is coordinated to substantially equalize the cooling of the varying thicknesses of the cast article in the cavity. That is accomplished by forming the casting cavity within the permanent mold somewhat oversized, with the overage in dimension correlated reversely to the thickness of the sections of the article cast within the cavity. Then, a sand material is blown into the cavity to form a sand liner whose thickness varies in accordance with the varying oversized dimensions of the cavity. The varying thickness of the liner, which is reversely coordinated to corresponding casting section thicknesses, permits generally equalized cooling of the casting within the cavity. That is, where the sand liner is thinner, a thicker section of the cast article will cool more rapidly and, conversely, where the sand liner is thicker, a thinner portion of the cast article will cool slower. Thus, the overall effect is a generally equalized cooling which permits removing the article from the cavity more rapidly.

In addition, in order to provide preselected areas at isolated locations on the surface of the cast article, portions of the metal cavity are left uncovered by the sand and are sized to form the desired dimension of the cast article sections which are overlapped thereby. Thus, bare metal wall portions form an extension of, or integral part of, the sand metal wall portions. Together the portions define the complete interior casting surface of the cavity. Where the bare metal areas contact molten metal entering the cavity, the molten metal is rapidly chilled. The hardness of such rapidly chilled metal is greater than the hardness of surrounding areas cooled in contact with the sand liner. Thus, preselected zones or areas of the surface of the cast article are formed with additional hardness characteristics during the casting process.

By rapidly filling the cavity with molten metal during the casting operation, e.g., utilizing a vacuum system for filling the cavity quickly, the desired overall strength and structural integrity of the cast article is obtained. That is, cracking or other damage which might have been anticipated because of the adjacent metal sections of different hardness is avoided. The overall time required for sufficiently cooling the cast article for removal from the mold is reduced because of the increase in the rate of cooling the thicker portions of the article and generally equalizing the cooling rate of the thinner portions to those of the thicker portions. Simultaneously localized harder surfaces are achieved.

One object of the invention is to form cast metal articles, rapidly, in mass production, using permanent metal molds, by generally equalizing the cooling temperature of the varying thicknesses of the article and simultaneously forming localized hard surface areas on the article during the casting and cooling process.

Another object of this invention is to provide a simplified mold construction which includes a variable thickness sand liner which, by correlating the thickness of the liner to the thickness of the sections of the cast article, tends to equalize the cooling of the metal within the cavity while enabling selected portions of the article to rapidly chill and form harder surface areas.

Still a further object of this invention is to enable the formation of hard surface areas at isolated, selected portions of a casting while casting variable thickness articles rapidly, on a mass production basis, within sand lined permanent metal molds.

These and other objects and advantages will become apparent upon reading the following description, of which the attached drawings form a part.

DETAILED DESCRIPTION

Figure 1:
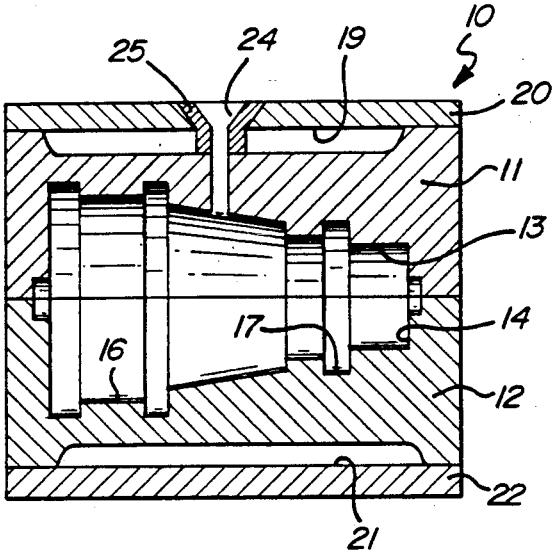
FIG. 1 is a schematic, cross sectional view of the permanent mold having an oversized casting cavity.

FIG. 1 illustrates schematically, in cross section, a permanent mold or flask 10 formed of an upper, cope 11 frame and a lower, drag frame 12. A casting cavity 13 is formed in the cope for overlapping a similar casting cavity 14 formed in the drag. Typically, the casting cavities are of different size and shape, depending upon the finished product to be cast. However, for illustration purposes, they are shown as being substantially identical and, in this case, used for casting a symmetrical, circular in cross section, article.

The interior wall or surface of the casting cavity formed in the permanent mold is oversized relative to the desired, finished dimension of the cast article. However, selected portions of the cavity are made to the required, finished dimension size. For example, an annular, ring-like area 16 and a similar, circular area 17 are formed to the size of corresponding portions of the cast article. These areas 16 and 17 will directly contact molten metal poured into the casting cavity.

A vacuum cavity 19 is formed in the cope. This is covered by a suitable plate or cover 20. Similarly, a vacuum cavity 21 is formed in the lower surface of the drag and this is covered by a base plate 22. The particular structure of the vacuum cavities may vary considerably and, therefore, they are shown schematically in the drawing.

A pouring opening or sprue 24 is formed in the cope and this may be lined with a suitable pouring insert 25. This is schematically shown in FIG. 1.

Figure 2:
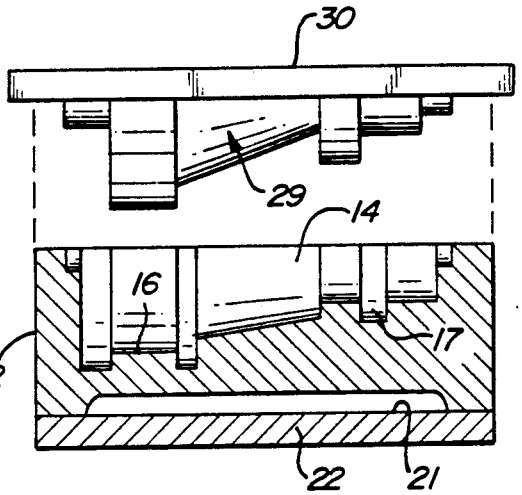
FIG. 2 is a schematic view, showing the drag portion of the mold in cross section and a pattern half positioned above the drag cavity.

As illustrated in FIG. 2, a typical pattern half 29 is arranged above the cavity 14 in the drag 12. The pattern half is mounted on the lower surface of a match plate or pattern board 30. The exterior surface of the pattern corresponds to the finished cast dimensions of the cast article. Thus, much of the exterior surface is considerably smaller, in dimension, than the major portion of the cavity in the drag.

A similar pattern half arrangement is provided for the cope. Similarly, the cope pattern half is of the required size for casting the article, that is, major portions of it are surrounded by the oversized wall portions of the permanent mold cavity.

Figure 3:
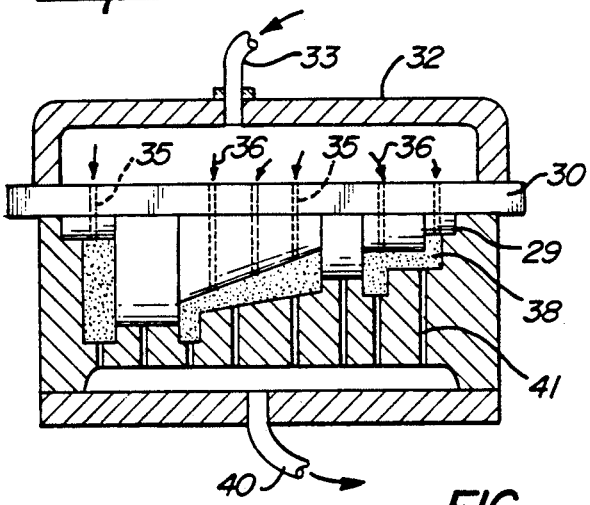
FIG. 3 schematically illustrates, with the mold portions in cross section and the pattern in elevation, the positioning of the pattern half within the drag cavity portion and the filling of the sand in the cavity for forming the sand liner.

As illustrated in FIG. 3, the match plate, with the pattern half, is positioned over the drag cavity. A sand box 32, which is schematically illustrated, is positioned over the pattern supporting board. The sand box may be provided with a compressed air pressure line 33 for carrying either compressed air or compressed air and sand, into the sand box and through openings 35. These openings extend through the board and pattern half into the space between the walls of the pattern and the permanent mold cavity. The flow of the sand is indicated by the arrows 36.

The sand is forced into the space between the pattern and the mold wall to form a variable thickness, sand liner 38. The flow of the sand is enhanced by a vacuum system built into the mold. That is, vacuum line 40 exhausts air from the cavity 21 through exhaust passageways 41 formed in the drag. This compacts the sand in the sand liner formed in the space between the pattern and the cavity wall.

As shown schematically, the sand liner has a variable thickness which is reversely correlated to the thickness of the cast part. That is, the sand liner is thicker where the part is thinner and the sand liner is thinner where the part is thicker. The thickness of the sand liner is correlated so as to generally equalize the cooling of the metal casting which loses heat to the metal walls of the permanent mold. By generally equalizing the cooling of the thin and thicker portions of the cast part, the overall cooling is faster than normal cooling and the mold may be opened and the part removed sooner. This permits faster, mass production casting. The correlated thicknesses can be determined by computer simulation or by trial and error or by both.

Figure 4:
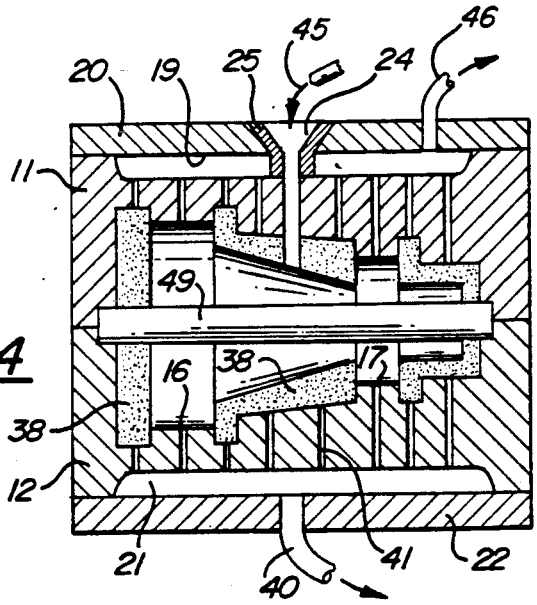
FIG. 4 schematically illustrates, in cross section, the assembled cope and drag portions of the mold flask with the sand liner applied and the casting of metal in the cavity.

The metal is poured into the mold, as indicated by the arrow 45 in FIG. 4, to fill the cavity produced by the aligned cope and drag cavities 13 and 14. This is illustrated in FIG. 4 which schematically shows the portions of the cavity that are lined with the sand liner and, the other portions 16 and 17 of the cavity which are unlined. As the molten metal enters the cavity, the vacuum line 40 evacuates the air from the drag cavity 14. Meanwhile, a similar vacuum line 46 in the cope vacuum cavity 19, removes air from exhaust passageways 47 formed through the cope.

Many castings are hollow and have interior configurations. Thus, it is common to use a core 49 for such castings. The core 49 is illustrative of the various kinds of cores that may be used and which are commonly made of a suitable sand and resin mixture that is baked.

Figure 6:
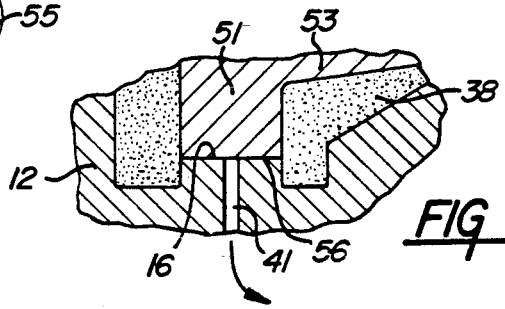
FIG. 6 is an enlarged, schematic, cross sectional view of a fragment of the mold and cast article illustrating portions of the article cast against the sand liner surface and other portions cast against bare metal in the mold cavity.

Most of the molten metal entering the cavity contacts the interior wall of the sand liner. But, some portions of the molten metal contact the bare metal areas which are uncovered by the sand liner. This is schematically shown in FIG. 6. Because of the vacuum assist, the metal rapidly contacts against the bare metal of the mold surface. That portion of the cast article chills and solidifies almost immediately. This forms a hardened surface at the selected areas of the article which correspond to the bare metal portions of the mold. The remaining portions of the molten metal solidify at different solidification rates depending upon the thickness of the sand liner. Since the sand liner acts as an insulator, the thicker the liner, the greater the resistance to cooling of the portion covered by that portion of the liner. Hence, by covering a thinner portion of the article with a thicker sand liner area, the thinner portion of the metal cools slower. Conversely, the thicker sections of the article cool more rapidly through thinner sand liner portions. This generally equalizes the cooling of the article which permits the article to be removed from the mold more rapidly. Otherwise, the article cannot be removed from the wall until its thicker areas are sufficiently cooled to enable handling the article.

Figure 5:
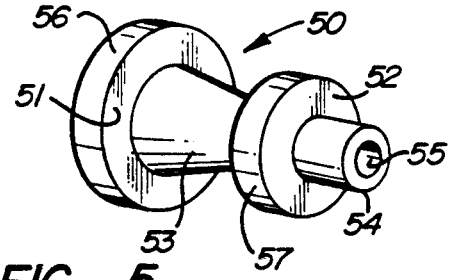
FIG. 5 is a schematic, perspective view, showing a cast article having varying wall thicknesses and hardened surface areas.

FIG. 5 illustrates an exemplification of a cast article 50 which includes a large disk portion 51, a smaller disk portion 52 and a tapered center connection portion 53. A cylindrical end 54 with a central hole 55, resulting from the use of the core, is shown. Significantly, the peripheral surface 56 of the large disk 51 and the peripheral surface 57 on the small disk 52 are formed as hardened surfaces due to their contacts with the bare metal of the permanent mold cavities. The particular areas which are hardened, that is, the areas where the molten metal contacts the bare metal of the cavity walls, may be flat or curved in shape and the size of the area may be varied, depending upon the requirements of the finished article.

The dimensions of the cavity, the sand liner inner casting surface, and the hardened areas may vary considerably. By way of an example, the sand liner may have a wall thickness of between about 0.125 to 4.00 inches to cast sections of metal ranging from between 0.125 to 5.00 inches in wall thickness.

This invention may be further developed within the scope of the following claims. Accordingly, it is desired that the foregoing description be read as being merely illustrative of an operative embodiment of this invention and not in a strictly limited sense.

Having fully described an operative embodiment, it is now claimed:

1. In a method for casting metal articles having integral sections of different thicknesses in a permanent, metal mold having an internal pre-formed casting cavity which is oversized a predetermined amount relative to the desired external dimensions of the cast article, and lining the wall defining the casting cavity with sand to form a temporary sand liner having an inner wall surface that defines an interior casting cavity of the finished size and shape desired for casting the cast article; and correlating the thickness of the sand liner reversely to the different thicknesses of the sections of the cast article, that is, with the liner being thicker where the article section is thinner and the liner being thinner where the cast article is thicker, and with the liner thickness being preselected to cause the article sections to cool at different rates so as to generally equalize the overall cooling time required to reach a temperature which permits removal of the cast article from the mold, and pouring molten metal into the mold for solidification therein, the improvement comprising:

providing at least two liner portions;

positioning said liner portions in said mold;

forming selected portions of the wall defining the metal mold cavity to the desired finish size and shape of the cast article;

forming at least one bare metal wall portions continuous about the mold in the interior sand liner wall between said at least two liner portions, for directly contacting and causing the cast molten metal in the mold to rapidly chill and solidify upon contact with such selected metal wall portions for producing hardened surface areas in the finished cast article at selected portions thereof; and applying a vacuum to the mold cavity through the at least two sand liner portions and at least one bare metal wall portion during the pouring of the molten metal for insuring full contact between the molten metal and the interior casting wall surface formed by the at least two sand liner portions and the preselected at least one metal wall portions.

2. A casting mold for casting molten metal articles having sections of different thicknesses and preselected surface portions of greater hardness than other surface portions, comprising:

a permanent, metal mold having a permanent mold cavity within which the molten metal is cast, with the mold cavity being defined by a wall surface that generally is oversized a predetermined amount relative to the finished dimensions of the cast article;

selected portions of the mold cavity wall being of a size which is correlated to the desired finished size of the corresponding sections of the cast article;

with the major portion of the wall surface dimensions being reversely correlated to the thickness of the cast article sections so that it is more oversized where article wall sections are thin and less oversized where the cast article sections are thicker;

at least two liners formed of sand applied against the mold cavity wall oversized major portion to provide a casting cavity, sand interior surface of the size and shape required for casting a particular article, so that the thickness of the sand liners is reversely correlated to the thickness of the different sections of the cast article, that is, the liners being thicker where the corresponding cast article section is thinner, and the liners being thinner where the corresponding cast article section is thicker with the thickness of the sand liners being selected for producing and approximately equalized cooling time for the cast article sections;

and with said selected portions of the permanent mold cavity being bare of the sand liner so as to contact the molten metal poured into the sand lined cavity, said bare portions being continuous about the mold circumference of the interior of the mold between the two liners for chilling the metal during casting of the metal in the mold for forming relatively harder surface areas at preselected locations on the finished cast article where such areas contacted the bare metal selected portions of the permanent mold while solidifying; and means for applying a vacuum to the mold cavity when cast metal is poured therein for insuring full contact between the molten metal and the bare metal selected portions for rapid uniform chilling of the molten metal at such selected portions, said vacuum means including ports in the liner portions and in the bare metal portions of the mold.

3. A casting mold as defined in claim 2, and including said mold being formed of a cope and a drag section which are aligned together for forming the complete mold, whereby the cope and drag may be separated for receiving a pattern around which sand may be applied within the mold cavity for forming the sand liner therein.

* * * * *